US006893276B2

(12) United States Patent
Muñoz et al.

(10) Patent No.: US 6,893,276 B2
(45) Date of Patent: May 17, 2005

(54) MULTI-WIRE CONNECTOR COMPRISING A LOCKING DEVICE

(75) Inventors: Luis Miguel Muñoz, Valls (ES); Andreu Calavera Alvarez, Valls (ES); Montserrat Galofre, Valls (ES)

(73) Assignee: Lear Corporation, Southfield, MI (US)

( * ) Notice: Subject to any disclaimer, the term of this patent is extended or adjusted under 35 U.S.C. 154(b) by 5 days.

(21) Appl. No.: 10/709,678

(22) Filed: May 21, 2004

(65) Prior Publication Data

US 2004/0198084 A1 Oct. 7, 2004

(30) Foreign Application Priority Data

Dec. 5, 2002 (ES) ..... PCT/ES02/00581

(51) Int. Cl.[7] ..... H01R 13/62
(52) U.S. Cl. ..... 439/157
(58) Field of Search ..... 439/157, 372, 439/152–153, 266, 296

(56) References Cited

U.S. PATENT DOCUMENTS

| | | | | | |
|---|---|---|---|---|---|
| 5,238,417 | A | | 8/1993 | Hatagishi | 439/153 |
| 5,888,081 | A | * | 3/1999 | Konoya et al. | 439/157 |
| 5,971,779 | A | | 10/1999 | Okabe | 439/157 |
| 6,019,620 | A | * | 2/2000 | Kodama et al. | 439/157 |
| 6,325,647 | B1 | | 12/2001 | May et al. | 439/157 |
| 6,345,995 | B1 | * | 2/2002 | Bigotto et al. | 439/157 |
| 6,767,231 | B1 | * | 7/2004 | Martin et al. | 439/157 |

* cited by examiner

*Primary Examiner*—Michael C. Zarroli
(74) *Attorney, Agent, or Firm*—Bill C. Pamagos

(57) ABSTRACT

A multi-wire connector with interlocking device by means of which a body of the connector, provided with a plurality of first connection terminals connected to respective conductive wires, is susceptible of being fitted and interlocked in a cavity of a base piece provided with other such second connection terminals provided for coupling with said first connection terminals.

6 Claims, 1 Drawing Sheet

MULTI-WIRE CONNECTOR COMPRISING A LOCKING DEVICE

BACKGROUND OF INVENTION

The present invention relates to a multi-wire connector with interlocking device by means of which a body of the connector, provided with a plurality of first connection terminals connected to respective conductive wires, is susceptible of being fitted and interlocked within a cavity in a base piece provided with other such connection terminals provided for coupling with said first connection terminals.

The invention is useful in the field of manufacturing and marketing electrical connectors for being used in the automotive industry.

Currently, multi-wire connectors are widely used which allow, by means of a single operation, to effect fast and safe connection of a plurality of electrical wires through respective connection terminal pairs, respectively fixed to a body and to a cavity of a base piece, susceptible of fitting each other effecting the simultaneous coupling of all terminal pairs.

The Spanish utility model ES-A-1047819, from the current applicant, discloses a connector provided with an improved lever. Such connector has a body provided with a plurality of first connection terminals connected to respective conductive wires for plugging into a base piece provided with other such second connection terminals. A lever shaped as an inverted "U" is jointed at the ends of its arms with regard to sides of the connector body. By virtue of such jointing, the lever can rotate a given angle between an open and closed position, said angle being limited by integral stops of the inner sides of said lever arms. In closed position, the bridge formed by the top end of the lever remains facing with a semi-cylindrical seat with an opposite concavity, determining between both a connection wire channeling strip. Both said semi-cylindrical seat and said lever bridge show resilient configurations that constitute a locking mechanism of one over the other when they are in said closed position to fix said ring-shaped strip around the cables, forming a bundle. These resilient configurations comprise side protuberances of the semi-cylindrical support, which are inserted in projecting lugs of the lever.

This connector, even though it has proven itself wholly effective in practice, with regard to the stops that limit the lever rotation angle and to the formation of said strip for the wire bundle when the lever is in closed position, shows some drawbacks susceptible of improvement. Firstly, the lack of interlocking means, which allow fixing the connector body in the base piece cavity when the connector is coupled and with all its terminal connected, it creates a disconnection risk due to vibrations or to tugging at the bundle of wires. On the other hand, the resilient configurations that constitute the lever locking mechanism on the semi-cylindrical support in the closed position are complex to form and awkward to handle.

The present invention solves the above problems by proposing a multi-wire connector of the type described above, provided with a interlocking device associated with said lever, to effect fixing of the connector body in the corresponding housing of the base piece at the same time that, by means of the displacement of said lever, a strip for confining the conductive wires that project from the connector body is configured, forming a bundle. The interlocking device comprises at least a first integral inter-locking configuration of a portion of the lever and at least a second integral interlocking configuration of an inner side wall of the cavity, the first and second interlocking configurations of which interfere with each other, remaining mutually interlocked when the lever is displaced from the open position to the closed position.

The connector of the present invention additionally contributes improvements in said lever locking mechanism in the closed position and in the stop configurations that limit the lever rotation angle. These improvements are to incorporate the stop configurations of the lever travel limits in side surfaces of the connector body to respectively interfere with first and second opposite side edges of the arms of the lever when the same is respectively in the open and closed positions, and in addition to place on said side surfaces of the connector body, from the open position to the closed position in the lever run, locking protuberances provided with a rounded or tapered edge and another abrupt opposite edge. These locking protuberances are arranged at the ends of respective flexible tabs which bend to the inside when the lever is displaced from the open position to the closed position by the effect of forces exerted by the arms against said tapered or rounded edges, allowing lever passage. Said flexible tabs resiliently recover when the lever overcomes the locking protuberances, whereby the abrupt edges thereof interfere with said second lever edges, immobilizing it in the closed position.

With these features, the connector of the invention has the advantage that, once the connector body is coupled to the base piece and the terminals are connected, by means of a simple lever displacement from the open position to the closed position three effects are achieved: the connector body remains fixed in the base piece cavity; the lever forms, in co-operation with the "U"-shaped support, said strip for the wire bundle; and the lever remains fixed in said closed position, preventing extraction of the connector body from the base piece and opening of said strip.

The lever locking mechanism in the closed position is reversible. By pressing with the fingers towards the inside on said flexible tabs, the lever is released and it can be returned to the open position, so that the wire bundle is released and the extraction of the connector body is enabled.

BRIEF DESCRIPTION OF DRAWINGS

Below, the invention is described in detail with reference to a specific embodiment example illustrated in the attached drawings, in which.

DETAILED DESCRIPTION

Figure 1:
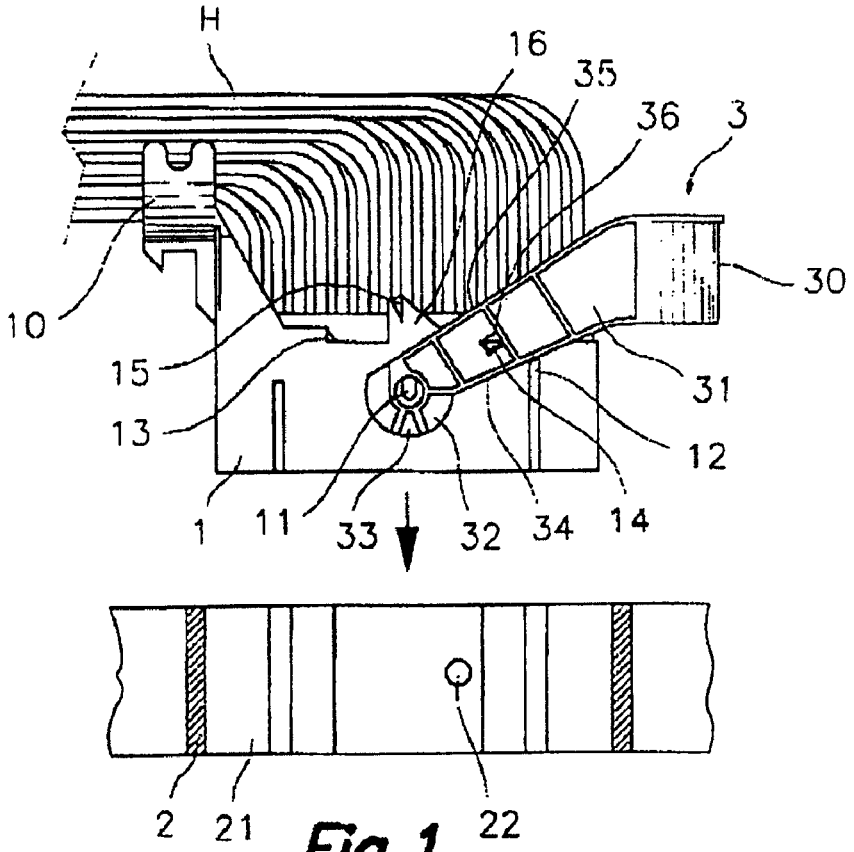
FIG. 1 is a side elevational view of the connector body about to be inserted in the base piece cavity, which is shown in vertical section for greater clarity.

With reference to FIG. 1, the multi-wire connector of the present invention comprises a body 1, which is provided with a plurality of first connection terminals (not shown) connected to respective conductive wires W that project from a top portion thereof. This body 1 is susceptible of fitting through its lower portion in a cavity 21 of a base piece 2, which is provided with other such second connection terminals (not shown) provided to couple with said first connection terminals when the body 1 is in a coupling position (shown in FIG. 2) within said cavity 21. In said top portion of the body 1, and projecting from it, a "U"-shaped support 10 is arranged with the concave portion facing upwards, which acts as a seating for said conductive wires.

Figure 2:
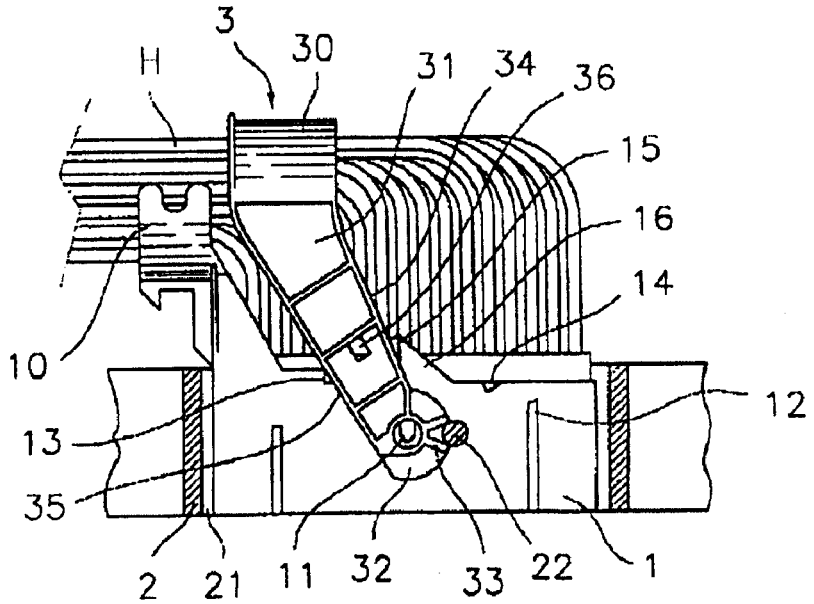
FIG. 2 is a side elevational view of the connector body inserted in the base piece cavity.

Associated to the body 1 is a lever 3, which comprises a bridge 30 and two arms 31 that extend from said bridge 30 to the body 1. These arms 31 are jointed at their ends with regard to opposite sides of the body 1 by means of projections 11, so that said lever 3 can rotate a certain angle between an open position, shown in FIG. 1, and a closed position, shown in FIG. 2. Stop configurations 12, 13 limit the lever run between an open position, shown in FIG. 1, and a closed position, shown in FIG. 2. Said stop configurations 12, 13 take the form of two pairs of first and second protuberances, each pair being arranged in one of said opposite sides of body 1. The positions of said first and second protuberances are such that they respectively interfere with first and second edges 34, 35 of opposite sides of the arms 31 of the lever 3, when the same is respectively in the open and closed positions. As shown in FIG. 2, when the lever 3 is in the closed position, the bridge 30 co-operates with said support 10 to confine between both the conductive wires W, forming a bundle.

The connector of the present invention includes means to releasably fix, i.e. interlock, the body 1 in said coupling position within said cavity 21 of the base piece 2. These means comprise first interlocking configurations 33, integral to end portions 32 of the lever 3, and second interlocking configurations 22, integral to opposite inner side walls of the cavity 21. Each one of said portions 32 is located at the end of one of the arms 31, so that the corresponding first interlocking configuration 33 remains close to a coupling hole to the corresponding joint snug 11. Advantageously, each portion 32, where the interlocking configuration 33 is placed, is located in one side of said coupling hole, angularly displaced from the rest of the arm 31.

The relative positions of the first and second interlocking configurations 33 and 22 are such that, when the body 1 is introduced in the cavity 21 with the lever 3 in said open position (FIG. 1), said first and second interlocking configurations 33 and 22 do not interfere with each other, allowing for the complete insertion of the body 1 and the coupling of said first and second connection terminals (not shown). When the body 1 is completely inserted in the coupling position within the cavity 21 of the base piece 2, rotation of the lever 3 is carried out from the open position to the closed position (FIG. 2). Once this rotation of the lever 3 is completed, the first interlocking configuration 33 is placed in a position that interferes with said second interlocking configuration 22, both remaining interlocked with each other preventing extraction of the body 1 from the cavity 21. Both the body 1 and said base piece 2 and the lever 3 are of a plastic material, slightly resilient, that allows mutual interlocking of said first and second interlocking configurations 33 and 22 by the passage of a part of the first ones over a part of the second ones by virtue of a certain elastic deformation of said pieces.

The connector of the present invention additionally includes locking configurations to immobilize the lever 3 in the closed position shown in FIG. 2, and by it to block the interlocking means described above of the body 1 within the cavity 21. Said locking configurations comprise a pair of locking protuberances 15 arranged at the ends of respective flexible tabs 16, which are coplanar with said opposite sides of the body 1 and extension thereof over the top portion of the body 1. Each one of the locking protuberances 15 has one of its edges rounded or tapered and another edge, abrupt. When the lever 3 is displaced from the open position to the closed position, said second edges 35 of the arms 31 bear on said rounded or tapered edges of the locking protuberances 15 exerting forces that make this flexible tabs 16 to bend towards the inside and likewise, in fact, the arms 31 open to certain extent, allowing passage of the lever 3 towards the closed position. When the lever 3 overcomes the locking protuberances 15, which occurs immediately after the second edges 35 of the arms 31 have abutted against the second protuberances 13, the flexible tabs 16 resiliently recover, by virtue of which the locking protuberances 15 interfere with said first edges 34 of the arms 31 preventing their return towards the open position whilst the second protuberances 13 abut against the second edges 35 limiting rotation of the lever 3 in the closed position. Thus, the lever 3 remains immobilized in the closed position (FIG. 2), position in which, in addition and as has been described above, said first and second interlocking configurations 32 and 22 are mutually interlocked, and the bridge 30 of the lever 3 remains in a suitable position to cooperate with said support 10 in confining the conductive wires W, forming a bundle.

To release the lever 3 from the locking configurations described above, it is enough to press on said flexible tab 16 with the fingers towards the inside and to push the lever 3 towards the open position. Thereby, the wire bundle is released and the first and second interlocking configurations 33 and 22 are released, enabling extraction of the body 1 from the cavity 21.

The arms 31 of the lever 3 also include, even if it is not essential, respective windows 36 in which fit retention protuberances 14, located in the sides of body 1 when the lever 3 is in the open position. Therefore, the lever 3 remains also releasably immobilized, in said open position, facilitating the assembly tasks.

Even if a specific embodiment example has been described and illustrated, a skilled person will come up with many variations and modifications without leaving the scope of the invention defined in the appended claims.

What is claimed is:

1. A multi-wire connector with interlocking device, said connector being of the type comprising:

a body (1) provided with a plurality of first connection terminals connected to respective conductive wires (W) projecting from a top portion, which body (1) is susceptible of fitting through the lower portion of;

a cavity (21) of a base piece (2) provided with other such second connection terminals provided for coupling with said first connection terminals when said body (1) is in coupling position within said cavity (21);

a "U"-shaped support (10) being arranged projecting from said body (1), and a lever (3) comprising a bridge (30) and arms (31) jointed at their ends with regard to opposite sides of said body (1) by means of projections (11), so that said lever (3) can rotate a certain angle, limited by stop configurations (12, 13), between an open position and a closed position, wherein said bridge (30) co-operates with said support (10) to confine said conductive wires (W), forming a bundle, locking configurations being arranged to immobilize said lever (3) in said closed position;

characterized in that means are provided for releasably interlocking said body (1) in said coupling position in said cavity (21) of said base piece (2), which means comprise at least a first interlocking configuration (33), integral to a portion (32) of said lever (3), and at least a second interlocking configuration (22), integral to an inner side wall of said cavity (21), in respective positions such that, when said body (1) is introduced in said cavity (21) with said lever (3) in said open position, said first and second interlocking configurations (33 and 22) do not interfere with each other, and when said lever (3) is placed in the closed position, said body (1) being in said coupling position, said first interlocking configuration (33) interferes with said second interlocking configuration (22), remaining both interlocked with each other, preventing extraction of said body (1) from said cavity (21); and further characterized that said lever (3) includes one of said portions (32) at the end of each arm (31), each portion (32) being arranged so that said corresponding first interlocking configuration (33) remains close to a coupling hole for the corresponding joint snug (11), and in that said cavity (21) includes two of said second interlocking configurations (22) arranged on opposite inner side walls thereof.

2. A connector as claimed in claim 1, characterized in that said portions (32) with said first interlocking configurations (33) are arranged at one side of said coupling hole angularly displaced from the rest of said arm (31).

3. A connector as claimed in claim 2, characterized in that said body (1), said base piece (2), and the lever (3) are made of a slightly resilient material allowing mutual interlocking of said first and second interlocking configurations (33 and 22) by the passage of at least part of the first ones over at least part of the second ones by means of a certain elastic deformation of said pieces.

4. A connector as claimed in claim 3, characterized in that it comprises two pairs of said stop configurations (12, 13), which adopt the form of first and second protuberances (12, 13) arranged on said opposite sides of said body (1) in such positions that they respectively interfere with first and second edges (34, 35) of opposite sides of said arms (31) of said lever (3) when the same is respectively in the open and closed positions.

5. A connector as claimed in claim 4, characterized in that said locking configurations to immobilize said lever (3) in the closed position comprise locking protuberances (15) arranged at the end of respective flexible tabs (16), extension of said opposite sides of said body (1) and projecting over the top portion thereof, said flexible tabs (16) which are bent towards the inside when said lever (3) is displaced from the open position to the closed position, due to the effect of forces exerted by said arms (31) against tapered or rounded edges of said locking protuberances (15), allowing for the passage of said lever (3) towards the closed position, and said flexible tabs (16) of which recover resiliently when said lever (3) overcomes said locking protuberances (15), which occurs immediately after said second edges (35) of said arms (31) have abutted against the second protuberances (13) and, by virtue of which, said locking protuberances (15) interfere with said first edges (34) of said arms (31), whereby said lever(3) is immobilized in the closed position in which in addition said first and second interlocking configurations(33 and 22) are mutually interlocked.

6. A connector as claimed in claim 5, characterized in that said arms (31) of said lever (3) include in addition respective windows (36) in which fit retention protuberances (14) located on sides of said body (1) to releasably immobilizes said lever (3) in the open position when said lever (3) is in said open position.

* * * * *